United States Patent [19]

Shin

[11] 4,121,597

[45] Oct. 24, 1978

[54] FILTERING PIPE WITH EXTINGUISHER FOR CIGARETTES

[76] Inventor: Suck Kyun Shin, 107-80, Hyunju-dong, Sudaemoon-ku, Seoul, Korea

[21] Appl. No.: 771,275

[22] Filed: Feb. 23, 1977

[30] Foreign Application Priority Data

Aug. 21, 1976 [KR] Rep. of Korea ..... 2053

[51] Int. Cl.[2] ..... A24D 1/10; A24F 13/08

[52] U.S. Cl. ..... 131/190; 131/10 R; 131/235 R; 131/256

[58] Field of Search ..... 131/1, 4 R, 4 A, 7, 131/8 A, 187, 190, 256, 15, 235 R, 235 ST, 9, 10

[56] References Cited

U.S. PATENT DOCUMENTS

| | | | |
|---|---|---|---|
| 1,792,430 | 2/1931 | Kruggely | 131/256 |
| 1,798,537 | 3/1931 | Honigbaum | 131/4 A |
| 1,996,002 | 3/1935 | Seaman | 131/15 A |
| 2,666,437 | 1/1954 | Lattof | 131/4 A |
| 3,091,243 | 5/1963 | Guida | 131/256 |

FOREIGN PATENT DOCUMENTS

| | | | |
|---|---|---|---|
| 142,429 | 11/1930 | Switzerland | 131/4 A |
| 348,094 | 9/1966 | Switzerland | 131/4 A |
| 891,074 | 3/1962 | United Kingdom | 131/4 A |
| 1,014,452 | 12/1965 | United Kingdom | 131/4 A |

*Primary Examiner*—Dalton L. Truluck
*Assistant Examiner*—V. Millin
*Attorney, Agent, or Firm*—David H. Semmes; Warren E. Olsen

[57] ABSTRACT

A filtering pipe of housing with built in extinguisher for cigarettes, such that the lighted ash of the cigarette is extinguished, as it communicates with a non-flammable, extinguishing portion of the filter. The filter includes an elongated housing, having a filter at the mouthpiece end and a ring of non-flammable, extinguishing material at the cigarette supporting end. A cigarette to be smoked is pushed outwardly of the housing such that the extinguishing ring abuts that portion of the cigarette where the lighted ash is to be extinguished.

9 Claims, 9 Drawing Figures

FILTERING PIPE WITH EXTINGUISHER FOR CIGARETTES

BACKGROUND OF THE INVENTION

1. Field of the Invention

Cigarette filters, particularly filter housing embodying an extinguishing device. The filter may embody an independent filter which operates conjointly with a conventional cigarette or a filter tip cigarette.

2. Summary of the Invention

This invention relates to a filter pipe having an automatic extinguisher for conventional cigarettes supported therein. A paper pipe, in which a conventional cigarette may be inserted, includes a filter in the mouthpiece end and a non-flammable extinguishing ring member on the inner side of the other end through which the cigarette to be smoked is inserted. As the cigarette is smoked, the lighted ash of the cigarette is extinguished as it contacts the extinguishing ring. Thus, according to the present invention, it is possible to control optionally the fractional length of the cigarette to be smoked by withdrawing the cigarette from the paper pipe, such that the non-flammable extinguishing ring contacts that segment of the cigarette which has been pre-selected as the stopping point.

When a conventional cigarette having a filter is smoked, it is customary that the smoker smokes a half, more or less, of the cigarette, then throws away the remaining cigarette butt because the cigarette butt never gives the smoker any fresh taste. The cigarette butt could endanger the smoker's heath due to the surplus of nicotine stored within the cigarette butt.

On the other hand, it is indeed a loss of material resources to throw away that half of the remaining cigarette which has not been smoked. Also, if the cigarette butt is not fully extinguished prior to being thrown away, there may be a danger of fire. And, of course, it is indeed unhygienic for the light of a cigarette to be extinguished by a rub with the smoker's fingers.

The present invention removes the foregoing defects, while providing that the reminder of the cigarette butt may be smoked repeatedly. Simultaneously, it is possible to maintain a fresh character in the smoke while filtering out any surplus of nicotine stored in the remaining cigarette butt. Also, even if the cigarette has not been extinguished, the ash of the cigarette shall be extinguished automatically by a non-flammable extinguishing ring member supported upon the inner side of one end of the filter pipe, according to the present invention.

DESCRIPTION OF THE PREFERRED EMBODIMENTS

Figure 1:
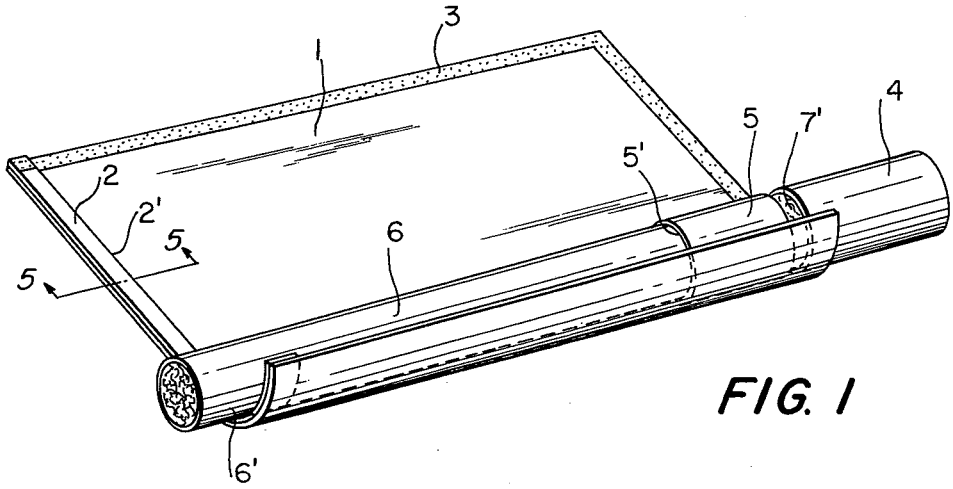
FIG. 1 is a perspective view, showing how a conventional cigarette is wrapped with paper to form the paper pipe characterized by this invention.

FIG. 1 shows how a conventional cigarette is wrapped by wrapping paper to form the automatically extinguishable filter pipe cigarette of this invention. The paper pipe of this invention consists of wrapping paper 1. The mouthpiece part and one of the side edges in the wrapping paper are pasted with adhesive 3 and the other cigarette supporting end of wrapping paper 1 is pasted with a non-flammable extinguishing material 2 such as aluminum, mica leaf, and/or asbestos paper, etc.

It is necessary that the wrapping paper 1 forming the paper pipe of this invention should be selected from those types of papers having a feeling to give somewhat a thickness and the length must be the same or somewhat larger than a conventional cigarette.

Figure 2:
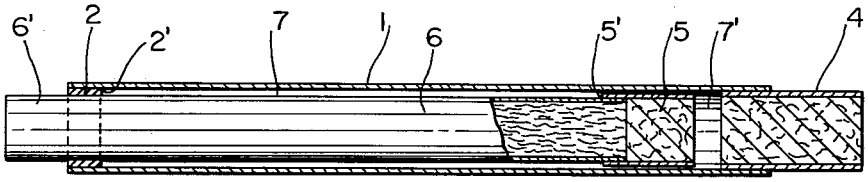
FIG. 2 is longitudinal section view of the filter pipe with automatic extinguisher for cigarettes according to the present invention.
Figure 3:
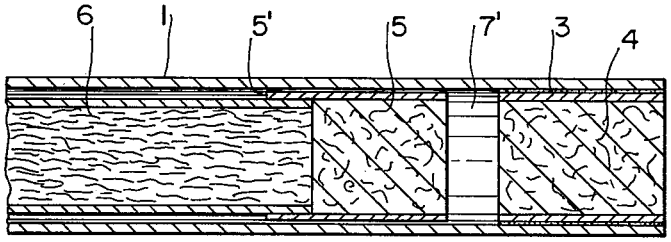
FIG. 3 is a longitudinal section view of another embodiment of the present invention, in which the additional filter of the paper pipe is supported entirely within an end of the paper pipe.
Figure 4:
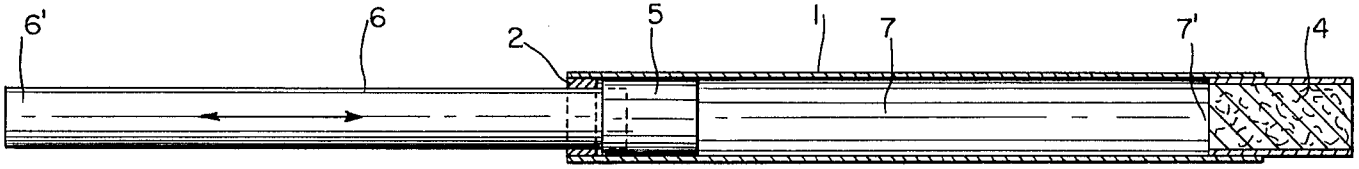
FIG. 4 is a longitudinal section, showing withdrawal or extension of a conventional cigarette from the paper pipe and prior to smoking.
Figure 8:
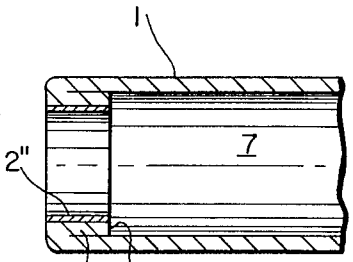
FIG. 8 is fragmentary vertical section of the embodiment according to FIG. 6.

According to the embodiment of this invention illustrated in FIG. 1, it is possible to put one-third of the filter 4 within the inside of the mouthpiece end of the paper pipe, with the remaining two-thirds extending outside of the paper pipe, as shown in FIG. 2. And, according to the embodiment of FIG. 3, it is possible to place filter 4 entirely within the inside the mouthpiece end paper pipe, as shown in FIG. 3. It is preferable to define the small space 7' between filter 5 of a conventional cigarette 6 and filter 4 of paper pipe 1, as shown in FIGS. 2 and 3. However, it is also possible that filter 5 and filter 4 may abut each other without making any space 7'. Since the diameter of the paper pipe of this invention is somewhat larger than a conventional cigarette, it is possible to insert a conventional cigarette into paper pipe 1. As a result, the especial and automatic extinguishing characteristics of the filter pipe may act upon a conventional cigarette.

As mentioned above, paper pipe 1 has two ends; the mouthpiece end is equipped with filter 4 and the cigarette supporting end with a non-flammable extinguishing ring member 2 through which the common cigarette 6 is withdrawn when the smoker smokes. As will be apparent, the inner diameter of the non-flammable extinguishing ring member 2 must be almost same as the outer diameter of cigarette 6 so that, during the smoking, air may not be leaked into the interior paper pipe 1 intermediate the contacting area between the inner diameter of ring 2 and the outer diameter of cigarette 6 when inserted.

Figure 7:
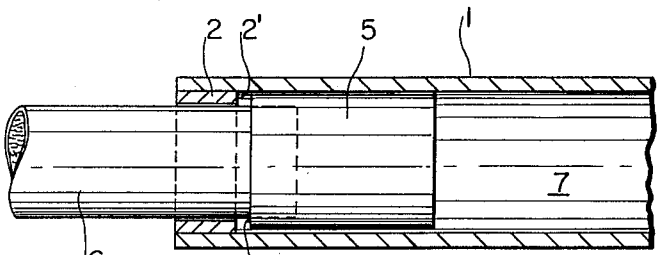
FIG. 7 is a fragmentary, vertical section showing interlocking contact of the non-flammable extinguishing ring member and the paper belt ring applied to the cigarette as it is inserted within the paper pipe, such that the cigarette may not be withdrawn.
Figure 5:
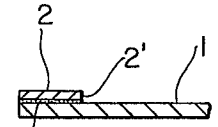
FIG. 5 is a fragmentary, vertical section of the non-flammable extinguishing ring member, taken along line 5—5 of FIG. 1.

Since, paper belt 5' adheres onto the joint area between the common cigarette 6 and its filter 5, cigarette 6 may not be fully withdrawn from paper pipe 1. Paper belt or ring 5' applied to the cigarette 6 abuts edge 2' of the non-flammable, extinguishing ring 2, as shown in the FIGS. 5 and 7. Therefore, unless cigarette 6 is pulled out strongly, cigarette 6 shall be locked within paper pipe 1 of this invention and may be drawn from the inside of the paper pipe 1 only so far as belt 5 abuts ring edge 2', as illustrated in FIG. 7.

Figure 6:
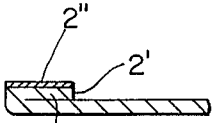
FIG. 6 is fragmentary, vertical section of another embodiment of the non-flammable extinguishing ring member, wherein the cigarette support end of the pipe is folded back and coated with an extinguishing chemical solution.

It is also possible to obtain a non-flammable extinguishing ring belt by folding downwardly a leading edge of the paper forming the paper pipe 1, upon which a non-flammable liquid has been applied in the cigarette supporting end, as illustrated in FIG. 6.

When the automatically extinguishable filter pipe cigarette prepared as above is smoked, the smoker should withdraw a part of the cigarette 6 from the paper tube 1 and light up the end 6' of the cigarette 6 which has been inserted in the paper pipe 1 of this invention.

When the cigarette has been smoked, the cigarette 6 may be burnt continuously until the lighted ash of the cigarette approaches the non-flammable ring member 2 of the paper pipe 1 of this invention. Even if the cigarette has not been smoked continuously, the lighted ash of the cigarette shall be extinguished automatically at the point where the cigarette contacts the non-flammable ring member 2. So, there is no necessity to extinguish conventionally the lighted ash of the cigarette by hand.

This is quite the same case as smoking a cigarette while using a pipe having a filter with the property of removing the nicotine.

For example, in case a smoker has left by mistake the cigarette which he is smoking, upon a flammable material, there is a conventional danger of a fire. However, when a smoker smokes the cigarette of this invention, the lighted ash of the cigarette will be extinguished automatically when the lighted end reaches the non-flammable ring member of the paper pipe. Accordingly, there never arises any danger of a fire.

Figure 9:
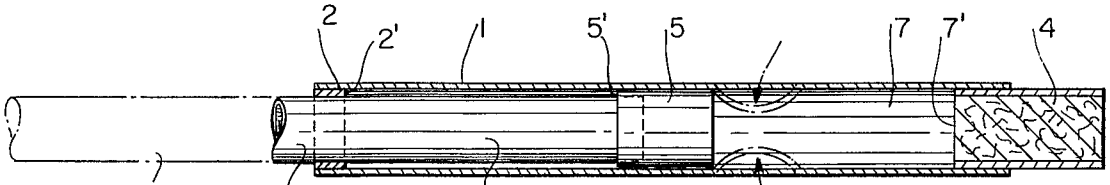
FIG. 9 is a longitudinal section illustrating how the cigarette inserted within the paper pipe may be pushed outwardly of the pipe for smoking fractional segments.

According to the present invention, the smoker may easily control, also, the length of the cigarette to be smoked. When the smoker is going to smoke a half of a cigarette at a time, he may withdraw a half of the cigarette which will be extinguished at the half-way point. The remaining part of the cigarette may be smoked at another time. As the smoker desires to smoke the remaining part of the cigarette, the smoker can easily push inwardly the paper pipe as indicated at 8 in FIG. 9, so that the cigarette 6 inserted in the paper pipe 1 can be pushed outwardly of the paper pipe 1 by the pressure of the smoker's fingers. Accordingly, by repeating the pushing operation, the smoker can easily expose the remaining functions of the cigarette butt for smoking at several intervals. Thus, the smoker can smoke effectively and economically fractional segments of a cigarette during several different time periods.

When the automatically extinguishable filter pipe cigarette of this invention is smoked, the nicotine in the cigarette shall be filtered firstly through filter 5 attached to cigarette 6 whereby the poisonous components in the cigarette smoke may be neutralized and oxidized; the smoke is then cooled in air space 7 of the paper pipe of this invention so that the amount of the nicotine may be reduced further. Furthermore, because the cigarette smoke is filtered additionally through filter 4 of paper pipe 1, it is true that the amount of the nicotine shall be reduced effectively, as compared with the cases where the smoker smokes directly a conventional cigarette. And, since the cigarette of this invention provides means for removing nicotine two or three times, it is possible to reduce or remove the harmful effects upon the smoker's health. Accordingly, the cigarette of this invention protects the health of the smoker.

As can be seen from the foregoing and the accompanying drawings, since the cigarette of this invention consists of a conventional common cigarette 6 supported in a paper pipe 1 as an integral body, there is no need to carry additional 3 pipes or filters for removing the nicotine. Thus, the cigarette of this invention offers the same effectiveness as an especial filter pipe for removing nicotine from a conventional cigarette. Since each of the conventional cigarettes is wrapped within fresh paper forming the paper pipe, the smoker enjoys the sensation of smoking each cigarette with a new paper pipe. The paper pipe of this invention can be manufactured at a low price and, even if the paper pipe of this invention is applied to conventional cigarettes, the paper pipe is not disadvantaged when compared with special filter pipes for removing nicotine. Moreover, according to the present invention, it is possible to smoke the entire cigarette inserted within the paper pipe, thus eliminating the wasteful habit of discarding unused fractions of the cigarette butt. As a result, waste of cigarettes is prevented with consequent economy.

I claim:

1. A filtering pipe with extinguisher for cigarettes comprising:

(A) an elongated housing, defining a mouthpiece end and a cigarette supporting end said housing being of tubular configuration and having an inner diameter approximating the outer diameter of a cigarette;

(B) an inner collar supported within said mouthpiece end, so as to engage the outer diameter of a cigarette wedged therein, while serving as a locking abutment with an annular ring of non-flammable extinguishing material as a cigarette is withdrawn from said housing;

(C) a filter supported within said mouthpiece end;

(D) a non-flammable extinguishing material supported upon said annular ring mounted within the inside of said cigarette supporting end.

2. A filtering pipe with extinguisher as in claim 1, said housing being adapted so as to define an air space intermediate said filter supported in said mouthpiece and the mouthpiece end of said cigarette.

3. A filtering pipe with extinguisher as in claim 2, said housing being adapted for support of a filter tip cigarette and defining an air space intermediate said filter tip and said filter supproted in said mouthpiece end.

4. A filtering pipe with extinguisher for cigarettes as in claim 3, said filter supported within said mouthpiece end being exteriorally co-extensive therewith.

5. A filtering pipe with extinguisher for cigarettes as in claim 3, said filter support in said mouthpiece end, extending outwardly of said housing.

6. A filtering pipe with extinguisher for cigarettes as in claim 1, said cigarette end and said filter supported in said mouthpiece and substantially abutting each other within said housing.

7. A filtering pipe with extinguisher for cigarettes as in claim 1, said housing being radially inwardly depressible, such that a smoker may push a cigarette end outwardly of said housing, so as to index increments of said cigarette with said annular ring, such that said cigarette will be extinguished as said fractional increment is indexed.

8. A filtering pipe with extinguisher for cigarettes as in claim 1, in combination with a cigarette supported within said housing such that its lighted end extends outwardly of said cigarette supporting end.

9. A filtering pipe with extinguisher for cigarettes comprising:

(A) an elongated housing, defining a mouthpiece end and a cigarette supporting end said housing being of tubular configuration and having an inner diameter approximating the outer diameter of a cigarette;

(B) an inner collar supported within said mouthpiece end, so as to engage the outer diameter of a cigarette wedged therein, while serving as a locking abutment with an annular ring of non-flammable extinguishing material as a cigarette is withdrawn from said housing;

(C) a filter supported within said mouthpiece end;

(D) a non-flammable extinguishing material supported upon said annular ring mounted within the inside of said cigarette supporting end said annular ring of non-flammable extinguishing material being defined by a fold-back of said housing at the cigarette supporting end and the application of extinguishing material to the inside of said fold-back portion.

* * * * *